US008453553B2

(12) United States Patent
Cannon

(10) Patent No.: US 8,453,553 B2
(45) Date of Patent: Jun. 4, 2013

(54) RADIALLY ORTHOGONAL, TUBULAR ENERGETICALLY ROTATED ARMOR (ROTERA)

(75) Inventor: Joseph P. Cannon, Lenox, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 199 days.

(21) Appl. No.: 13/183,784

(22) Filed: Jul. 15, 2011

(65) Prior Publication Data

US 2013/0014637 A1 Jan. 17, 2013

(51) Int. Cl.
*F41H 5/007* (2006.01)
*F41H 5/18* (2006.01)

(52) U.S. Cl.
USPC ..... 89/36.17; 89/902; 89/919

(58) Field of Classification Search
USPC ..... 89/36.17, 902, 919, 36.01
See application file for complete search history.

(56) References Cited

U.S. PATENT DOCUMENTS

| | | | | |
|---|---|---|---|---|
| 370,356 | A | | 9/1887 | Schuetz |
| 1,636,486 | A | | 7/1927 | Planche |
| 2,393,350 | A | | 1/1946 | Wiedman |
| 2,974,594 | A | | 3/1961 | Boehm |
| 2,988,008 | A | | 6/1961 | Wankel |
| 3,431,818 | A | | 3/1969 | King |
| 3,611,932 | A | | 10/1971 | Clator |
| 3,893,368 | A | | 7/1975 | Wales, Jr. |
| 4,368,660 | A | | 1/1983 | Held |
| 4,665,794 | A | | 5/1987 | Gerber et al. |
| 4,752,970 | A | * | 6/1988 | Arakaki ..... 2/2.5 |
| 5,025,707 | A | | 6/1991 | Gonzalez |
| 5,070,764 | A | | 12/1991 | Shevach et al. |
| 5,293,806 | A | | 3/1994 | Gonzalez |
| 5,294,079 | A | | 3/1994 | Draznin et al. |
| 5,370,034 | A | | 12/1994 | Turner et al. |
| 5,637,824 | A | | 6/1997 | Benyami |
| 5,824,941 | A | | 10/1998 | Knapper |
| 5,866,839 | A | | 2/1999 | Ohayon |
| 5,915,291 | A | | 6/1999 | Weihrauch et al. |
| 6,244,156 | B1 | | 6/2001 | Steuer et al. |
| 6,327,955 | B1 | | 12/2001 | Kerdraon et al. |
| 6,345,563 | B1 | | 2/2002 | Middione et al. |
| 6,622,608 | B1 | | 9/2003 | Faul et al. |
| 6,681,679 | B2 | | 1/2004 | Vives et al. |
| 6,880,445 | B2 | | 4/2005 | Benyami et al. |
| 7,202,809 | B1 | | 4/2007 | Schade et al. |
| 7,299,736 | B2 | | 11/2007 | Mayseless |

(Continued)

*Primary Examiner* — Bret Hayes
*Assistant Examiner* — Reginald Tillman, Jr.
(74) *Attorney, Agent, or Firm* — David L. Kuhn; Thomas W. Saur; Luis Miguel Acosta

(57) ABSTRACT

A reactive armor that includes a tube having a substantially central longitudinal axis, and at least two force reaction faces that are parallel to the axis; a casing that includes a back, at least two sides, and at least two end blocks; wherein the sides extend away from the back, the blocks are fastened to the sides at edges opposite of the back, and the tube is positioned between the blocks to form a cover to the casing; initiators included between the end blocks and the force reaction faces; a sensor subsystem that detects a threat, wherein the sensor subsystem is coupled to the initiators, and the sensor subsystem generates an initiation signal in response to the detection of the threat; and when the initiators receive the initiation signal, the initiators substantially simultaneously generate a force such that the tube is rotated about the axis to rotationally defeat the threat.

20 Claims, 3 Drawing Sheets

U.S. PATENT DOCUMENTS

| | | | |
|---|---|---|---|
| 7,357,061 | B2 | 4/2008 | Yael et al. |
| 7,360,479 | B2 | 4/2008 | Yael et al. |
| 7,424,845 | B2 | 9/2008 | Zank et al. |
| 7,540,229 | B2 | 6/2009 | Seo et al. |
| 7,603,939 | B2 | 10/2009 | Cohen |
| 7,752,952 | B1 | 7/2010 | Hohil et al. |
| 7,827,900 | B2 | 11/2010 | Beach et al. |
| 2006/0065111 | A1 | 3/2006 | Henry |
| 2006/0162539 | A1 | 7/2006 | Fucke et al. |
| 2009/0107326 | A1 | 4/2009 | Benyami et al. |

* cited by examiner

RADIALLY ORTHOGONAL, TUBULAR ENERGETICALLY ROTATED ARMOR (ROTERA)

GOVERNMENT INTEREST

The invention described here may be made, used and licensed by and for the U.S. Government for governmental purposes without paying royalty to me.

BACKGROUND OF THE INVENTION

1. Field of the Invention

The present invention generally relates to reactive armor, and in particular, to a radially, orthogonal, tubular energetically rotated armor and method.

2. Background Art

Conventional reactive armor structures and systems that are configured to defeat projectile and/or other threats include systems and methods that have been implemented with varying degrees of success since the 1970's. U.S. Pat. Nos. 4,368,660; 4,665,794; 4,981,067; 5,025,707; 5,293,806; 5,637,824; 5,824,941; 6,311,605; 6,345,563; 6,846,372; 7,424,845; 7,540,229; and U.S. Published Applications 2006/0065111; 2006/0162539; and 2009/0173250 provide examples of some conventional protective armoring structures, systems, and methods.

However, conventional reactive armor generally presents compromises and limitations in performance, generally manifested as inadequate performance against threats and/or potential hazard to nearby individuals and/or equipment, collateral damage, and the like. In many cases, conventional reactive armors are either too fast reacting or too slow reacting for effective defeat of some threats. As such, there is a desire for improved reactive armor systems and methods.

SUMMARY OF THE INVENTION

Accordingly, the present invention may provide an improved system and method for reactive armor.

According to the present invention, a system for a reactive armor may be provided. The reactive armor may include: a tube having a substantially central longitudinal axis, and at least two force reaction faces that are parallel to the axis; a casing that includes a back, at least two sides, and at least two end blocks; the sides extend away from the back, the blocks are fastened to the sides at edges opposite of the back, and the tube is positioned between the blocks to form a cover to the casing; initiators included between the end blocks and the force reaction faces; a sensor subsystem that detects a threat, wherein the sensor subsystem is coupled to the initiators, and the sensor subsystem generates an initiation signal in response to the detection of the threat; and when the initiators receive the initiation signal, the initiators substantially simultaneously generate a force such that the tube is rotated about the axis to rotationally defeat the threat.

The force reaction faces are bases of wedges that are formed on the outer surface of the tube.

The force reaction faces are surfaces on plates located on one or both ends of the tube and substantially at the axis.

The tube is formed from at least one of aluminum, light weight steel, and titanium.

In one embodiment, the initiators are chemical explosive material.

In another embodiment, the initiators are magnetic force impulse reactive devices.

The tube has a preferred diameter of less than 6 inches.

The tube has a diameter in a range of 2 inches to 6 inches.

The tube has a wall thickness in a range of 1/16 inch to V1 inch.

The rotational velocity of the tube reaches greater that 1000 revolutions per second in response to the force.

Further, the present invention may provide a method for defeating a threat, the method comprising: (a) mounting a reactive armor to a structure to be protected from the threat, wherein the armor includes: a tube having a substantially central longitudinal axis, and at least two force reaction faces that are parallel to the axis; a casing that includes a back that is mounted to the structure, at least two sides, and at least two end blocks; wherein the sides extend away from the back, the blocks are fastened to the sides at edges opposite of the back, and the tube is positioned between the blocks to form a cover to the casing; initiators included between the end blocks and the force reaction faces; a sensor subsystem, wherein the sensor subsystem is coupled to the initiators; (b) generating an initiation signal via the sensor subsystem in response to detection of the threat, and transmitting the initiation signal to the initiators; and (c) generating a force such that the tube is rotated about the axis to rotationally defeat the threat, when the initiators receive the initiation signal.

The force reaction faces are bases of wedges that are formed on the outer surface of the tube.

The force reaction faces are surfaces on plates located on one or both ends of the tube and substantially at the axis.

The tube is formed from at least one of aluminum, light weight steel, and titanium.

The initiators are chemical explosive material.

The initiators are magnetic force impulse reactive devices.

The tube has a preferred diameter of less than 6 inches.

The tube has a diameter in a range of 2 inches to 6 inches.

The tube has a wall thickness in a range of 1/16 inch to 1/4 inch.

The rotational velocity of the tube reaches greater that 1000 revolutions per second in response to the force.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Definitions and Terminology

Figure 1:
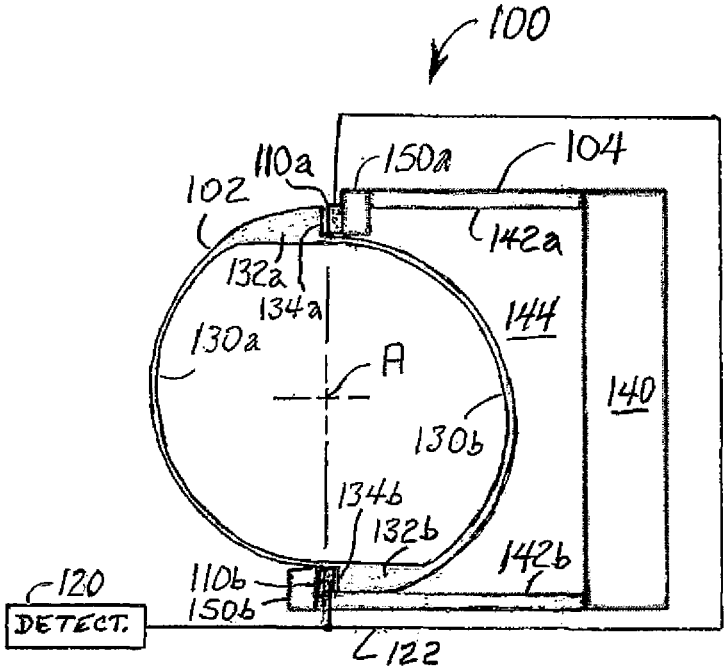
FIG. 1 is a diagram illustrating the end view of an embodiment of a reactive armor.

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated.

A plurality of items, structural elements, compositional elements, materials, subassemblies, and the like may be presented in a common list or table for convenience. However, these lists or tables should be construed as though each member of the list is individually identified as a separate and unique member. As such, no individual member of such list should be considered a de facto equivalent of any other member of the same list solely based on the presentation in a common group so specifically described.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

With reference to the Figures, the preferred embodiments of the present invention will now be described in detail. Generally, the present invention provides an improved system and method for reactive armor. In particular, a Radially, Orthogonal, Tubular Energetically Rotated Armor (ROTERA) is generally provided. Structures that may be protected by a reactive armor according to the present invention are vehicles such as tanks, armored personnel carriers, armored fighting vehicles; armored static structures such as buildings, above-ground portions of bunkers or shelters, containers for the storage of water, fuel, chemicals, munitions; and the like. The reactive armor system and method according to the present invention may be implemented as stand-alone armor, or alternatively may be implemented in connection with (e.g., integrated with) conventional passive armor and/or conventional active armor.

Referring to FIG. 1, an end view of a reactive armor mechanism (e.g., apparatus, device, system, assembly, subassembly, etc.) 100 is shown. The reactive armor system 100 generally comprises a tube 102, a casing 104, at least one rotation initiator 110 (e.g., a pair of rotation initiators 110*a* and 110*b*), and a detector subassembly (system) 120.

The tube (i.e., generally tubular or cylindrically shaped element) 102 generally has a central, longitudinal axis, A. The tube 102 may include a pair of substantially thin wall sections 130 (e.g., walls 130*a* and 130*b*). Respective wedge (tooth) shaped sections 132 (e.g., wedges 132*a* and 132*b*) may be formed on or integral with the outer surface of the wall sections 130.

Each of the wedges 132 generally includes a base (e.g., force pad, foot, force reaction surface, etc.) 134 (e.g., respective bases 134*a* and 134*b*). The bases 134 may be substantially longitudinal; and have a face that is parallel to the axis, A. The tube 102 is generally positioned such that the bases 134 are adjacent to a respective initiator 110 (i.e., the wedge 132*a* generally includes a base 134*a* that is adjacent to the initiator 110*a*; and the wedge 132*b* generally includes a base 134*b* that is adjacent to the initiator 110*b*). Relative to the radial surface of the tube 102, each of the bases 134 are generally facing opposing directions, similar to teeth on a ratchet wheel.

The casing 104 may comprise a back 140, sides (walls) 142 (e.g., a side 142*a* and a side 142*b*), and end plates (blocks) 150 (e.g., an end plate 150*a* and an endplate 152*b*). The back 140 is generally positioned (i.e., mounted, located, fixed, fastened, attached, etc.) such that the armor 100 provides protection to a vehicle, building, and the like, as described above. The walls 142 are generally positioned (i.e., located, fixed, fastened, attached, etc.) to extend perpendicularly from opposing edges of the back 140 to form a void 144. The tube 102 is generally positioned to cap (cover) the void 144.

One of the walls 142 (e.g., the wall 142*a*) may be shorter that the other wall (e.g., the wall 142*b*). The end plate 150*a* may be adjacent to the end of the wall 142*a* that is opposite the back 140. The initiator 110*a* may be positioned between the end plate 150*a* and the base 134*a*. The end plate 150*b* may be adjacent to the end of the wall 142*b* that is opposite the back 140. The sides 142 extend away from the back 140, each of the blocks 150 are fastened to the sides 142 at edges opposite of the back 140. The initiator 110*b* may be positioned (i.e., located, fixed, fastened, attached, included, etc.) between the end plate 150*b* and the base 134*b*.

The initiators 110 may be implemented as apparatuses that generate rapid, propelling force to rapidly rotate the tube 102 about the axis, A, when triggered. In one example, the initiators 110 may be implemented as explosive devices such as strips of C4, dynamite, or the like. In another example, the initiators 110 may be implemented as opposing (e.g., opposite polarity) plates that generate magnetic capacitance force. However, the initiators 110 may be implemented as any appropriate rapid, propelling force generating devices to meet the design criteria of a particular application as would be understood by one of skill in the art.

The detection system (e.g., sensor system, alert system, etc.) 120 generally includes a connector subsystem (e.g., link, interconnect, wire, cable, tubing, etc.) 122 to provide communication with the initiators 110 (i.e., to couple the detector 120 to the initiators 110). The detection subassembly 120 may be implemented as a conventional sensor equipped threat detection and alert apparatus. Examples of apparatuses that may be implemented as the detection subassembly 120 may be found in (i) U.S. Pat. No. 7,202,809, issued Apr. 10, 2007 to Schade et al., which is incorporated by reference in its entirety; and (ii) U.S. Pat. No. 7,827,900, issued Nov. 9, 2010 to Beach et al., which is incorporated by reference in its entirety; however, the detection and alert sensor system 120 may be implemented via any appropriate apparatus to meet the design criteria of a particular application as would be known to one of skill in the art.

Figure 2:
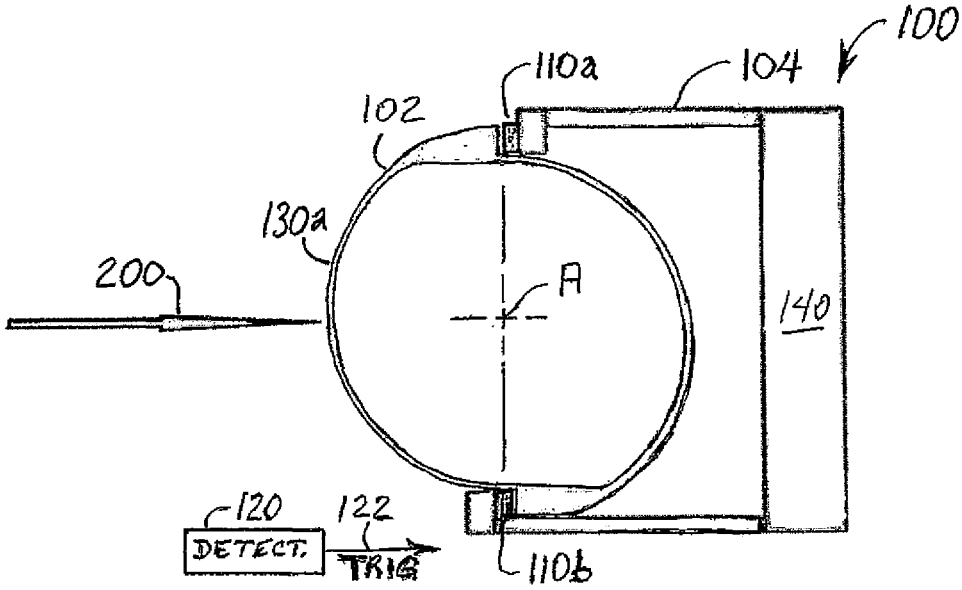
FIG. 2 is a diagram illustrating the end view of the reactive armor of FIG. 1 when approached by a threat.

Referring to FIG. 2, an end view of the armor 100 is illustrated at a time shortly before impingement (i.e., hit, strike, penetration, etc.) of a threat 200 into the armor 100 (i.e., when the threat 200 is imminent). The threat 200 may include one or more projectiles, metal fragments, fluid metals, penetrating jets ("thorns", "spikes", etc.) as generated by chemical energy rounds, high energy kinetic rounds, and the like. The armor 100 is generally positioned such that the longitudinal, outer radial surface of the tube 102 faces the anticipated direction of the threat 200, and the area to be protected is thus behind the back 140 of the casing 104. The armor 100 may potentially mitigate, disrupt, diminish, reduce, and/or eliminate damaging or harmful effects of the threat 200 and collateral effects.

When an imminent threat (e.g., the threat 200) is detected, the alert system 120 may generate a signal (e.g., TRIG). The signal TRIG is generally transmitted substantially simultaneously to the initiators 110.

Figure 3:
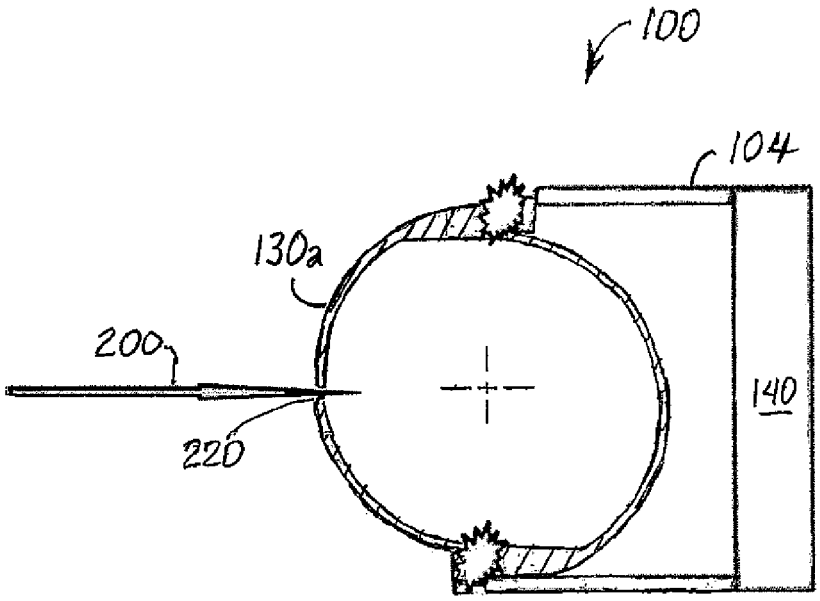
FIG. 3 is a diagram illustrating the end view of the reactive armor of FIG. 1 during reaction to a threat, wherein a tubular element of the reactive armor is shown as a sectional view.
Figure 4:
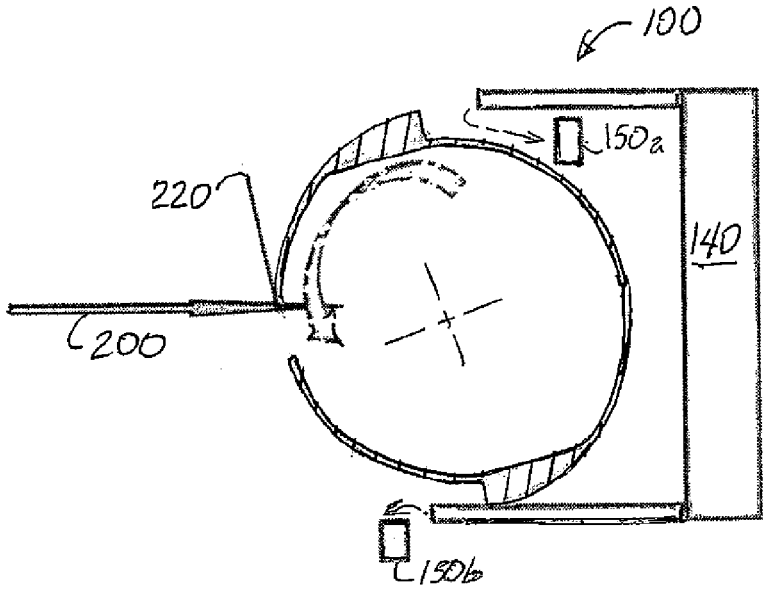
FIG. 4 is a diagram illustrating the end view of the reactive armor of FIG. 3 during further reaction to the threat.
Figure 5:
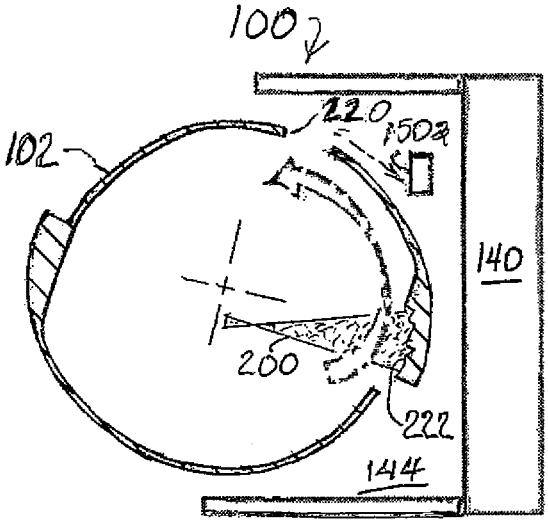
FIG. 5 is a diagram illustrating the end view of the reactive armor of FIG. 4 during yet further reaction to the threat.

Referring to FIG. 3, an end view of the armor 100 is illustrated at a time shortly after impingement (i.e., hit, strike, penetration, etc.) of the threat 200 into the armor 100. Impingement of the threat 200 may generate a rupture (e.g., hole, tear, puncture, intrusion, etc.) 220. However, the threat 200 may not necessarily penetrate the tube 102. For clarity of explanation, the tube 102 is illustrated as a sectional end view at the location of the rupture 220.

When the initiators 110 receive the signal TRIG, the initiators 110 may generate a rapid, forceful response (e.g., explosion, repulsion, and the like) against the respective bases 134 and the end plates 150 that may generate rapid, propelling forces to rapidly rotate the tube 102 about the axis, A.

The armor 100 generally comprises a reactive armor mechanism that utilizes the rotationally accelerated tube 102 to impinge and defeat the threat 200 and/or penetration 220. The tube 102 generally disrupts the threat 200. The armor 100 generally utilizes energetic force (e.g., explosive force, magnetic capacitance force, etc.) generated via the initiators 110 to rapidly accelerate a tubular armor material 102 about the central axis, A; thus feeding the undamaged armor material of the walls 130 and/or wedges 132 into the incoming threat 200, similar to a grinding wheel. With the armor 100, the objective is to not throw material such as occurs when a conventional reactive armor, for example, conventional flyer plate armor, is implemented to defeat threats. Rather, in response to the threat 200, the armor 100 generally rotates the material of the tube 102 around the central axis, A, impinging the threat 200 in a manner similar to a grinding wheel. As such, the armor 100 has the potential to reduce the risk of fratricide and collateral damage.

The tube 102 is generally implemented from common metallic materials that are significantly lighter than solid monolithic armor. Such metallic materials may include aluminum, light weight steel, titanium, thin composite, and the like. As such, the armor 100 has the potential to achieve a significant mass efficiency when compared to conventional armor approaches, especially conventional non-reactive armor where thick layers of heavy materials such as steel and ceramic are implemented.

The ROTERA system 100 generally rotates a tubular object (i.e., the tube 102) into the path of an incoming projectile (i.e., the threat 200). As the incoming stream of threat particles 200 hit the tube 102, the rotating tube 102 feeds fresh metallic material of the walls 130 and the teeth 132 into the path of the threat stream 200 disrupting the particle alignment and defeating the threat 200.

Rotating the tube 102 is generally implemented by providing substantial, balanced and immediate force as generated by the initiators 110, rotating the tube 102 at or above 1000 revolutions per second. Explosive or extreme magnetic force impulse from the initiators 110 is generally implemented to achieve this rotational acceleration. The force generated from the reaction of the initiators 110 generally rotates of the tube 102 in the appropriate amount of time in response to the signal TRIG that is transmitted by the detection system 120 when the threat 200 is imminent. This a significant energetic force event achieved through magnetic force impulse or explosive force impulse as generated by the initiators 110.

Figure 6:
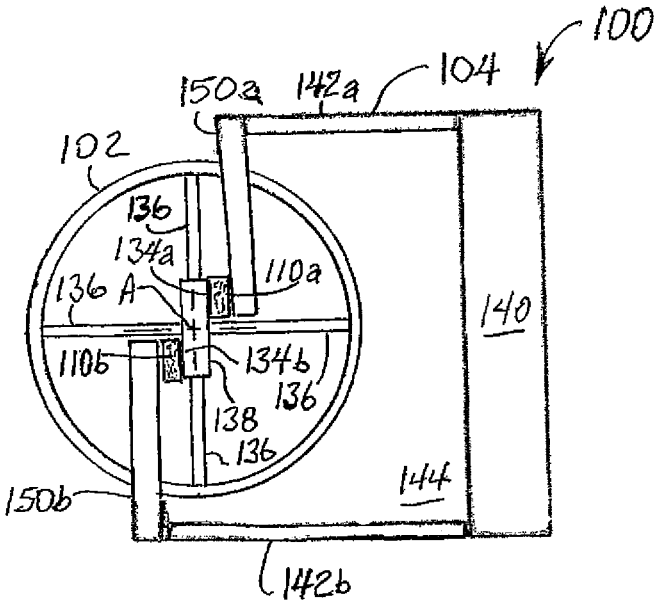
FIG. 6 is a diagram illustrating the end view of an alternative embodiment of a reactive armor.

Referring to FIG. 6, an end view of an alternative embodiment of the tube 102 is illustrated. As illustrated in FIG. 6, the armor 100 may be implemented having a tube 102 that has spokes (e.g., legs, etc.) 136 and a plate (e.g., tab, etc.) 138 having a face that is parallel to the axis, A; instead of the wedges 132. The plate 138 may be located on one or both ends of the tube 102; substantially at the axis, A; and may be fastened to one or more of the spokes 136. The force pads (force reaction faces) 134 may be implemented as surfaces on the outer opposing faces of the plate 138. The end blocks 150 are generally extended generally towards the axis, A, at the end of the tube 102 to provide a force reaction surface face that is adjacent to the initiator 110, while remaining recessed and substantially adjacent to the outer surface of the tube 102 for remainder of the length of the tube 102 to form an "L" shape.

The impulse force that is generated by the initiators 110 may be either applied with a force reaction face at the base of teeth shaped elements (i.e., at bases 134) shown in FIGS. 1-5, or, alternatively, through axial or shaft loading via the force reaction faces 134 near the axis, A, similar to a tire on a motorized vehicle as illustrated on FIG. 6.

The tube 102 may comprise of a tube of 6 inches or less diameter (e.g., a range of 2 inches to 6 inches). The wall 130 may have a thickness that can be varied (e.g., a range of 1/16 inch to 1/4 inch), but thicker wall diameter may be desirable to keep tube deformation to a minimum during reaction to the threat 200. The rotational velocity of the tube 102 generally reaches greater that 1000 revolutions per second. A large energetic force impulse is generated when the initiators 110 are activated in response to an imminent threat 200. Explosive or magnetic force from the initiators 110 generally provides the acceleration and rotational velocity to the tube 102.

The triggering mechanism 120 is implemented to energize the system (i.e., generate the signal TRIG in response to detection of the threat 200). The detection system 120 may include a break screen/make screen routed to a magnetic power source (e.g., capacitor and the like) to create a magnetic energetic event when the initiators 110 are implemented to provide magnetic capacitive force. A low order explosive trigger that would set off a larger order explosive may also be implemented to initiate an explosive energetic event when the initiators 110 are implemented as chemical explosive materials or devices. The triggering mechanism 120 is implemented using an apparatus that acts (i.e., transmits the signal TRIG) faster than the threat 200 to initiate the energetic event that rotates the tube 102.

When the threat particle 200 activates the triggering device 120, the triggering device 120 set offs the energetic mechanism (i.e., transmits the signal TRIG which activates the initiators 110) that drives the tube 102 in a rotational fashion. See FIGS. 2-5. Once the energetic event is initiated, the ROTERA 100 tube 102 rotationally accelerates and begins impinging the threat particle stream 200. This impingement is continuous as the tube 102 rotates. Note also the displacement of the end plates 150. As the tube 102 is impinged by the threat 200, the disrupted threat 200 particles misalign and spread apart in the tube hole (break-up zone, interior of the tube 102) 220. See FIGS. 3-5. Eventually the disrupted threat 200 particles will reach the back side of the rotating tube 102, and again be impinged (e.g., impingement 222), and disrupted by the tube wall 130. The remaining threat particles 200 that still penetrate the back wall 130 of the rotating tube 102 will generally disperse and be caught (captured) by the passive vehicle armor back 140 behind ROTERA 100 in the void 144. See FIG. 5.

As is apparent then from the above detailed description, the present invention may provide an improved system active armor.

Various alterations and modifications will become apparent to those skilled in the art without departing from the scope and spirit of this invention and it is understood this invention is limited only by the following claims.

What is claimed is:

1. A reactive armor comprising:

a tube having a substantially central longitudinal axis, and at least two force reaction faces that are parallel to the axis;

a casing that includes a back, at least two sides, and at least two end blocks; wherein the sides extend away from the back, the blocks are fastened to the sides at edges opposite of the back, and the tube is positioned between the blocks to form a cover to the casing;

initiators included between the end blocks and the force reaction faces;

a sensor subsystem that detects a threat, wherein the sensor subsystem is coupled to the initiators, and the sensor subsystem generates an initiation signal in response to the detection of the threat; and when the initiators receive the initiation signal, the initiators substantially simultaneously generate a force such that the tube is rotated about the axis to rotationally defeat the threat.

2. The reactive armor of claim 1, wherein the force reaction faces are bases of wedges that are formed on the outer surface of the tube.

3. The reactive minor of claim 1, wherein the force reaction faces are surfaces on plates located on one or both ends of the tube and substantially at the axis.

4. The reactive armor of claim 1, wherein the tube is formed from at least one of aluminum, light weight steel, and titanium.

5. The reactive armor of claim 1, wherein the initiators are chemical explosive material.

6. The reactive armor of claim 1, wherein the initiators are magnetic force impulse reactive devices.

7. The reactive armor of claim 1, wherein the tube has a preferred diameter of less than 6 inches.

8. The reactive armor of claim 1, wherein the tube has a diameter in a range of 2 inches to 6 inches.

9. The reactive armor of claim 1, wherein the tube has a wall thickness in a range of 1/16 inch to 1/4 inch.

10. The reactive armor of claim 1, wherein rotational velocity of the tube reaches greater that 1000 revolutions per second in response to the force.

11. A method for defeating a threat, the method comprising:

(A) mounting a reactive armor to a structure to be protected from the threat, wherein the armor comprises:

a tube having a substantially central longitudinal axis, and at least two force reaction faces that are parallel to the axis;

a casing that includes a back that is mounted to the structure, at least two sides, and at least two end blocks; wherein the sides extend away from the back, the blocks are fastened to the sides at edges opposite of the back, and the tube is positioned between the blocks to form a cover to the casing;

initiators included between the end blocks and the force reaction faces;

a sensor subsystem, wherein the sensor subsystem is coupled to the initiators;

(B) generating an initiation signal via the sensor subsystem in response to detection of the threat, and transmitting the initiation signal to the initiators; and (C) generating a force such that the tube is rotated about the axis to rotationally defeat the threat, when the initiators receive the initiation signal.

12. The method of claim 11, wherein the force reaction faces are bases of wedges that are formed on the outer surface of the tube.

13. The method of claim 11, wherein the force reaction faces are surfaces on plates located on one or both ends of the tube and substantially at the axis.

14. The method of claim 11, wherein the tube is fowled from at least one of aluminum, light weight steel, and titanium.

15. The method of claim 11, wherein the initiators are chemical explosive material.

16. The method of claim 11, wherein the initiators are magnetic force impulse reactive devices.

17. The method of claim 11, wherein the tube has a preferred diameter of less than 6 inches.

18. The method of claim 11, wherein the tube has a diameter in a range of 2 inches to 6 inches.

19. The method of claim 11, wherein the tube has a wall thickness in a range of 1/16 inch to 1/4 inch.

20. The method of claim 11, wherein rotational velocity of the tube reaches greater that 1000 revolutions per second in response to the force.

* * * * *